US007784292B2

(12) United States Patent
Lee et al.

(10) Patent No.: US 7,784,292 B2
(45) Date of Patent: Aug. 31, 2010

(54) ICE LEVEL DETECTION STRUCTURE FOR ICE MAKERS

(75) Inventors: Hong-Yi Lee, Taipei Hsien (TW); Chia-Hsin Hsu, Taipei Hsien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 350 days.

(21) Appl. No.: 11/954,938

(22) Filed: Dec. 12, 2007

(65) Prior Publication Data

US 2009/0151372 A1 Jun. 18, 2009

(51) Int. Cl.
*F25C 5/18* (2006.01)

(52) U.S. Cl. ..... 62/137; 62/344

(58) Field of Classification Search ..... 62/137, 62/344

See application file for complete search history.

(56) References Cited

U.S. PATENT DOCUMENTS 3,648,476 A * 3/1972 Linstromberg ..... 62/137
3,863,461 A * 2/1975 Bright ..... 62/137
3,885,400 A * 5/1975 Webb ..... 62/137
3,964,269 A * 6/1976 Linstromberg ..... 62/137
4,719,762 A * 1/1988 Osabe ..... 62/137
4,835,978 A * 6/1989 Cole ..... 62/137
6,427,456 B2 * 8/2002 Niwa et al. ..... 62/137
7,134,292 B2 * 11/2006 Oh ..... 62/137

* cited by examiner

*Primary Examiner*—William E Tapolcai
(74) *Attorney, Agent, or Firm*—Muncy, Geissler, Olds & Lowe, PLLC

(57) ABSTRACT

An ice level detection structure for ice makers is located on an ice maker to detect the ice level of ice cubes actually stored in an ice trough. It includes a detection rack located above the ice trough. The ice maker has a motor and a transmission means to transmit the detection rack. Through mechanical transmission the detection rack can accurately judge the ice level of the ice cubes actually stored in the ice trough.

16 Claims, 10 Drawing Sheets

ICE LEVEL DETECTION STRUCTURE FOR ICE MAKERS

FIELD OF THE INVENTION

The present invention relates to an ice level detection structure for ice makers and particularly to a detection structure adopted mechanical transmission to precisely judge the ice level of ice cubes actually held in an ice trough during ice making process.

BACKGROUND OF THE INVENTION

Many refrigerators have an automatic ice making system built inside. After ice cubes have been produced by an ice maker, they are collected in an ice trough, and an ice level detection means is provided to detect whether the ice level of the accumulated ice cubes has reached a high limit beyond the storage capacity of the ice trough and determine whether to stop ice making. If the ice level detection means malfunctions the ice maker will continuously make ice and the ice cubes will accumulate and result in damage of ice sweeping element and ice making tray or the like. Refer to FIG. 1 for the general structure of a conventional ice maker. It includes a control box to provide an ice making process, an ice making tray, an ice sweeping element and an ice trough located at a lower side of the ice maker (may be a retrievable ice collection tray as shown in the drawing). There is an ice level detection means located above the ice trough. The conventional ice level detection means has a linear detection device. Take the ice making process of a conventional ice maker as an example. After ice cubes have been produced in the ice making tray, the control box activates the ice sweeping element to move the ice cubes from the ice making tray to the ice trough to be accumulated. The control box temporarily suspends ice making process in the ice making tray during the ice sweeping operation. If the ice cubes accumulated in the ice trough have reached a saturated condition and arrived a lower limit detection position of the linear detection device, the linear detection device is pushed by the accumulated ice cubes and the ice sweeping element stops ice sweeping action. Namely the ice maker remains at the ice sweeping step and suspends the ice making process. The linear detection device performs detection through a horizontal line. As cracks are often formed among the ice cubes, the linear detection device could fall in the cracks without being pushed. Hence during the next ice sweeping operation the ice cubes accumulate continuously and squeeze the linear detection device that could cause malfunction of the linear detection device. As a result, the ice maker continuously produces ice and the ice cubes are accumulated in the ice trough and ice making tray. After a period of time, the ice cubes thaw and bond together to become a big and hard ice chunk. The ice sweeping element, ice making tray and control box could be damaged. In such a condition even if users have found out the problem they cannot immediately clear the ice trough. As the control switch of the ice making system usually is located outside the control box, users have to cut off electric supply of the entire refrigerator to melt the ice cubes in the ice trough before clearing the ice chunk. It often happens that the linear detection device is deformed and damaged beyond repairs by the pushing stress of the ice cubes. Hence to provide improvement for the ice level detection means of the ice maker is an issue remained to be resolved in the industry.

SUMMARY OF THE INVENTION

The primary object of the present invention is to solve the aforesaid disadvantages. The present invention provides a detection structure that adopts mechanical transmission to precisely judge the ice level of ice cubes actually stored in an ice trough during ice making process.

To achieve the foregoing object the detection structure of the invention includes:

a detection rack located above the ice trough that has a transmission shaft and a detection portion connecting to the transmission shaft; and a motor located in the ice maker and a transmission means located between the motor and the transmission shaft to transmit driving power output from the motor to drive the transmission shaft and the detection portion to generate a detection displacement in the ice trough that includes a return position and a detection position to allow the detection portion to precisely judge the ice level of ice cubes actually stored in the ice trough.

Another object of the invention is to couple the detection displacement of the detection structure with an ice sweeping displacement into a synchronous mechanical chain action such that in the event of malfunction occurred to any of the displacements ice making process is suspended.

To achieve the foregoing object the motor and transmission means of the invention synchronously transmit an ice sweeping member and the detection portion so that the detection displacement of the detection portion is corresponding to the ice sweeping displacement of the ice moving member to accurately judge the ice level and immediately suspend ice making process or the ice sweeping displacement.

Yet another object of the invention is to provide a panel detection portion of a larger area because of a greater mechanical transmission driving power is provided in the invention.

To achieve the object set forth above the detection portion includes a plurality of detection blades to increase the horizontal detection area so that it can be securely pushed by the accumulated ice cubes to accurately judge the ice level.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
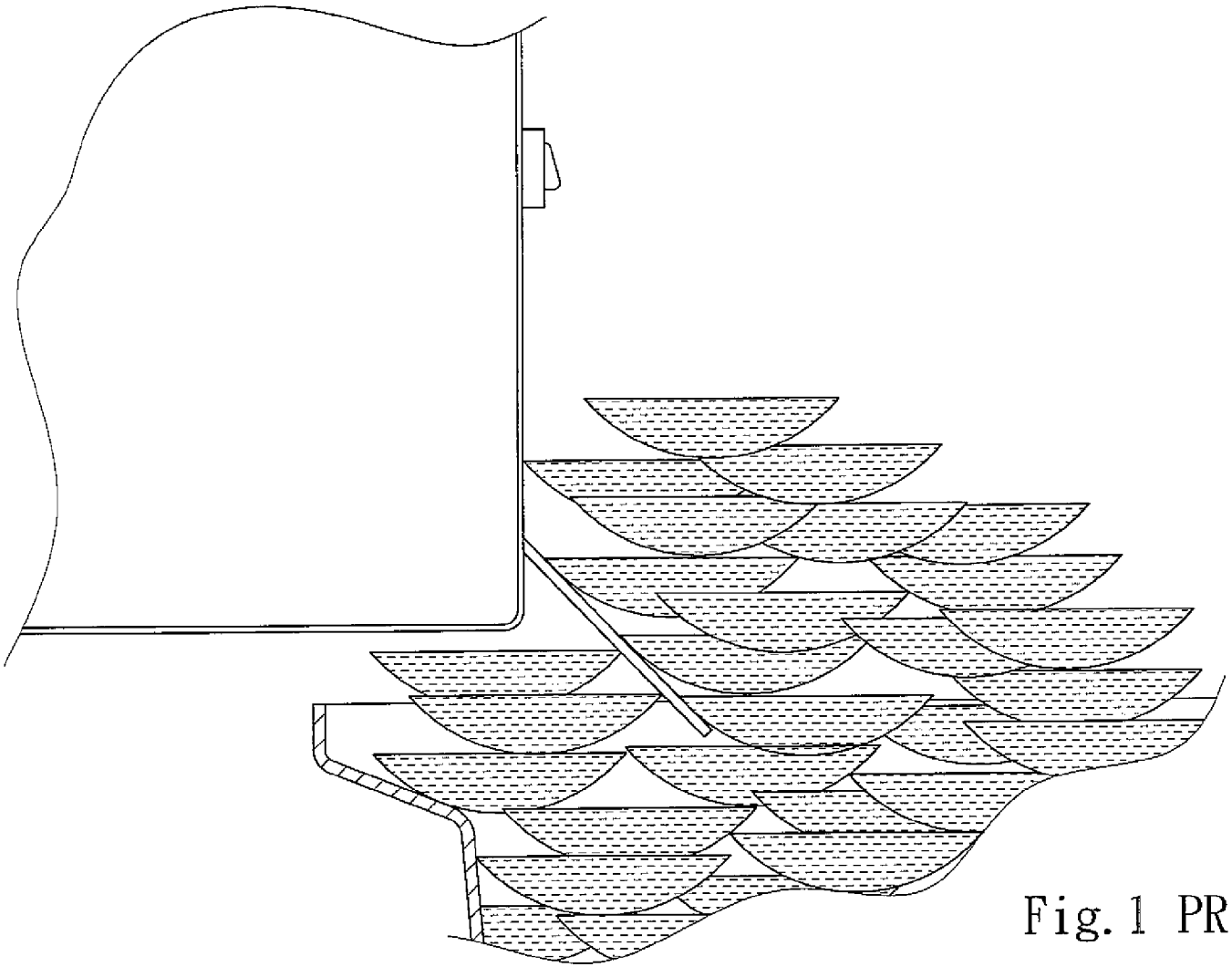
Fig. 1 PRIOR ART
FIG. 1 is a schematic view of a conventional ice maker in an ice making condition.
Figure 2:
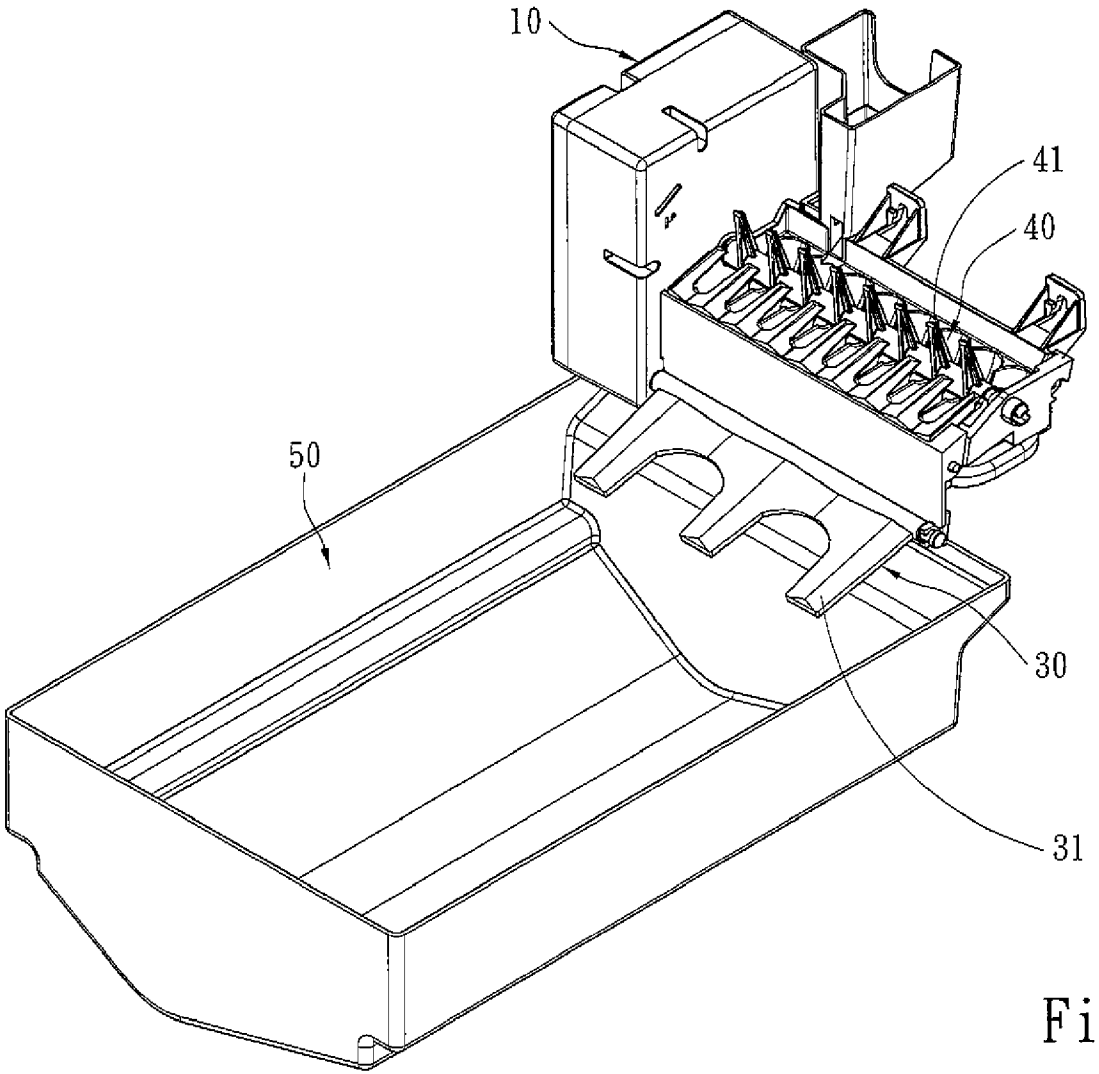
FIG. 2 is a perspective view of the invention.
Figure 3:
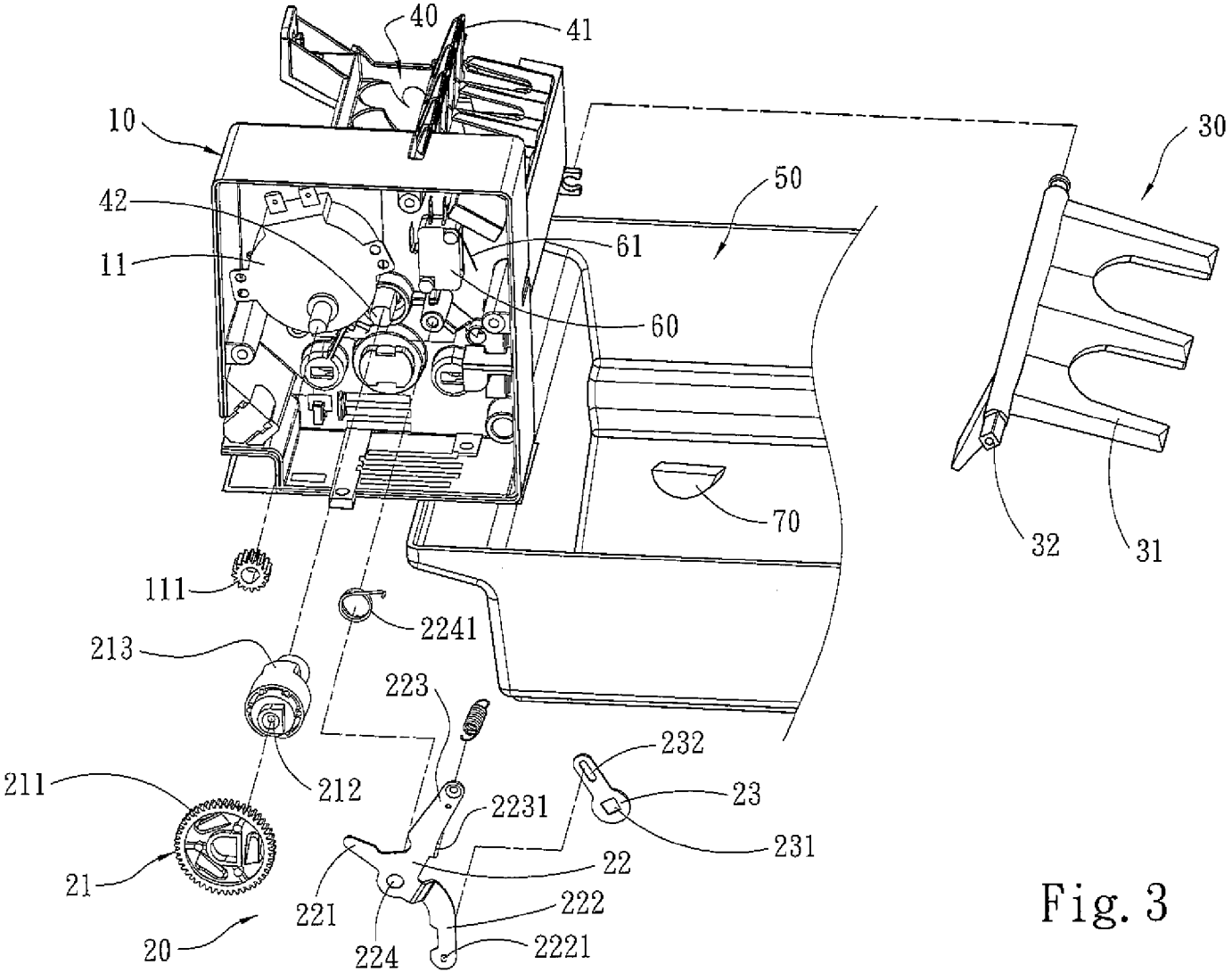
FIG. 3 is an exploded view of the invention.
Figure 4A:
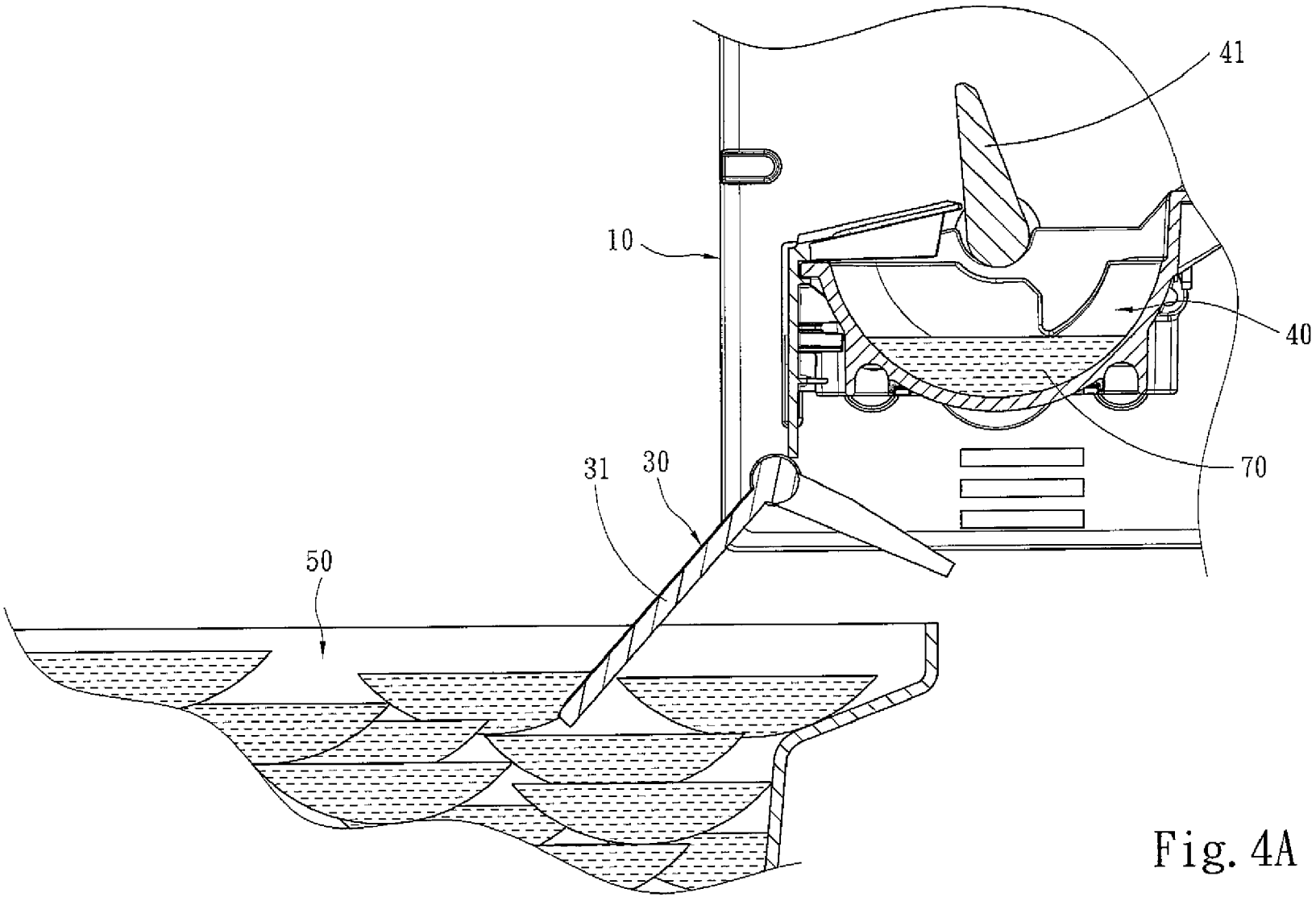
FIGS. 4A through 5C are schematic views of the detection structure of the invention in operating conditions.
Figure 4B:
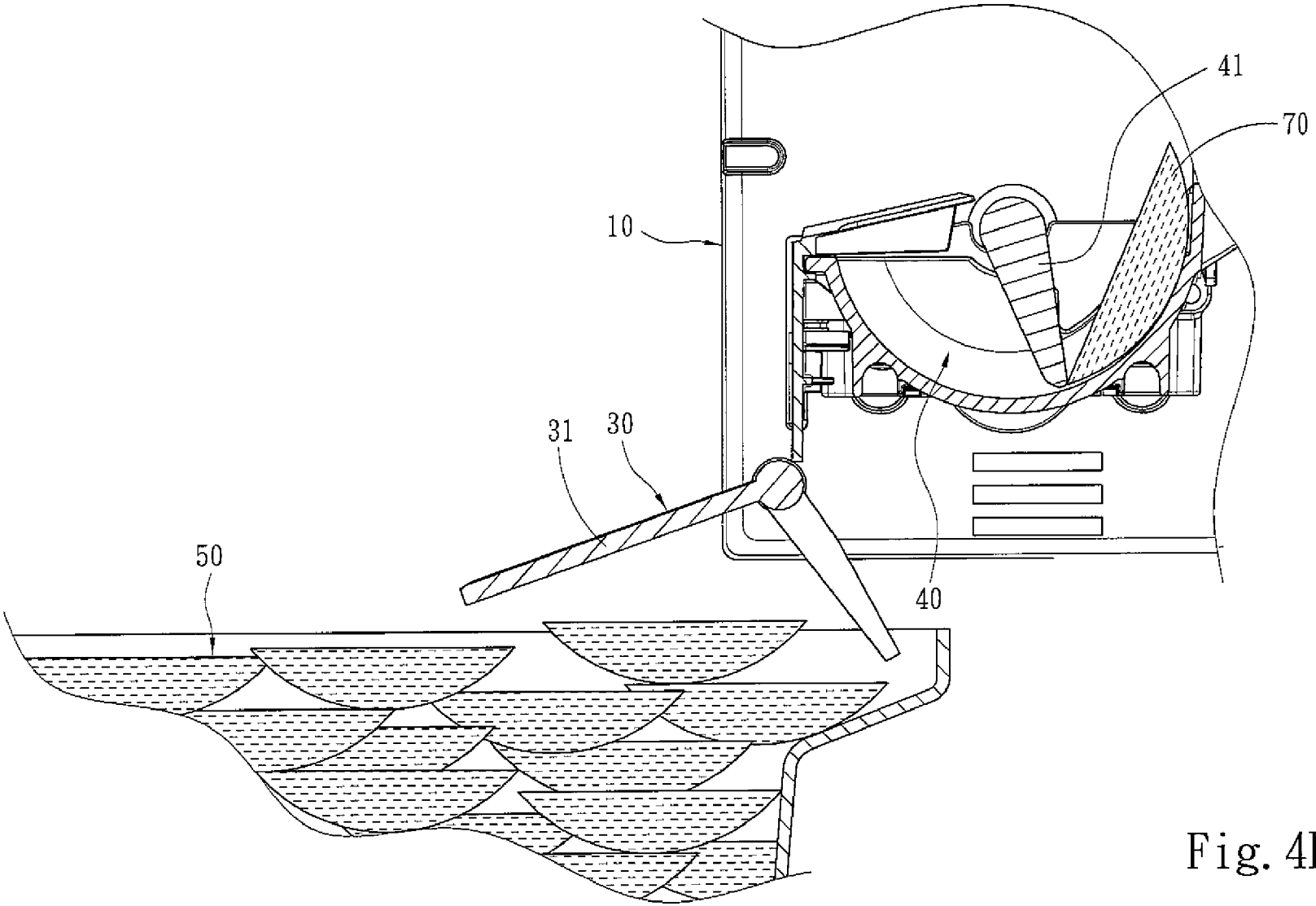
Figure 4C:
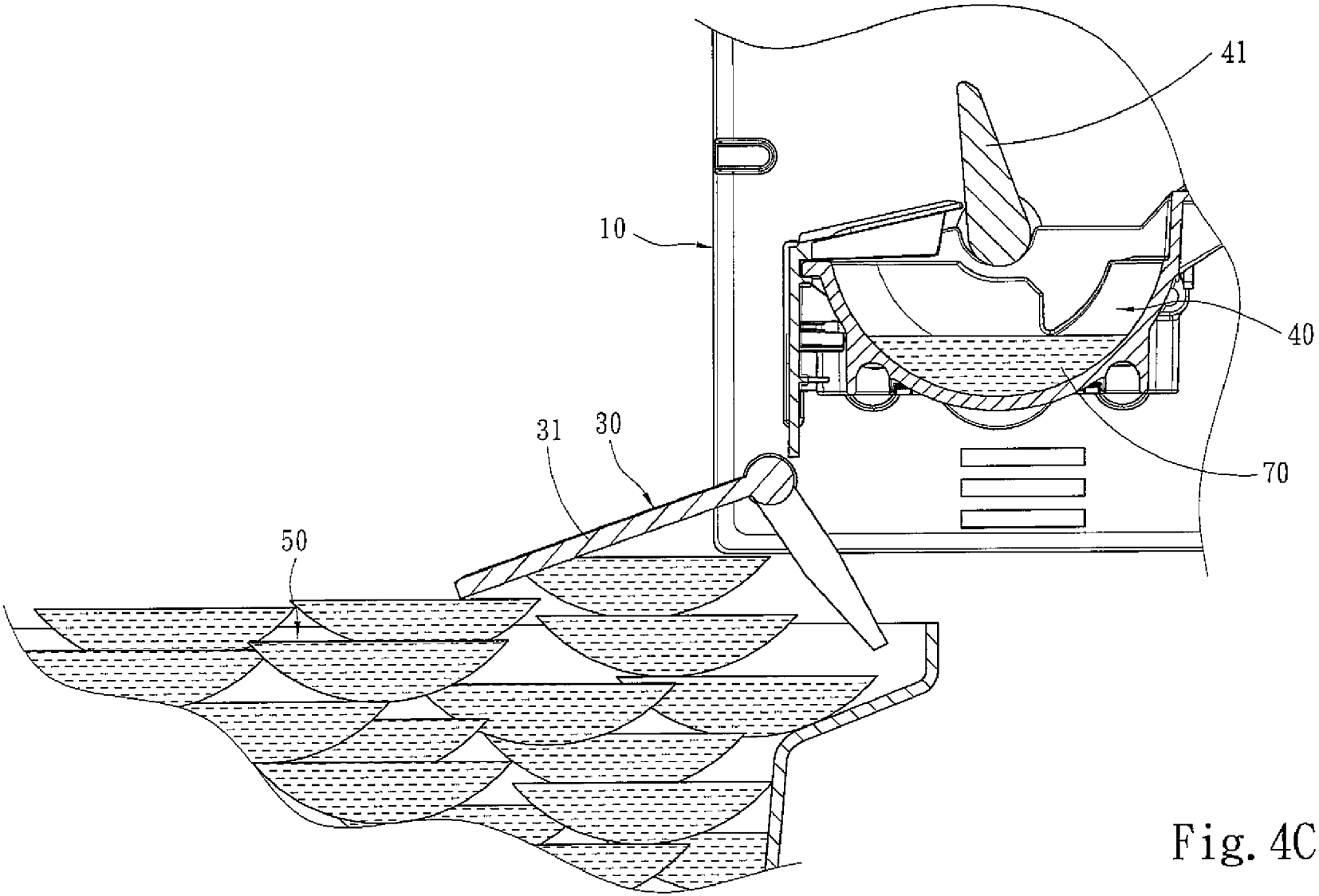
Figure 5A:
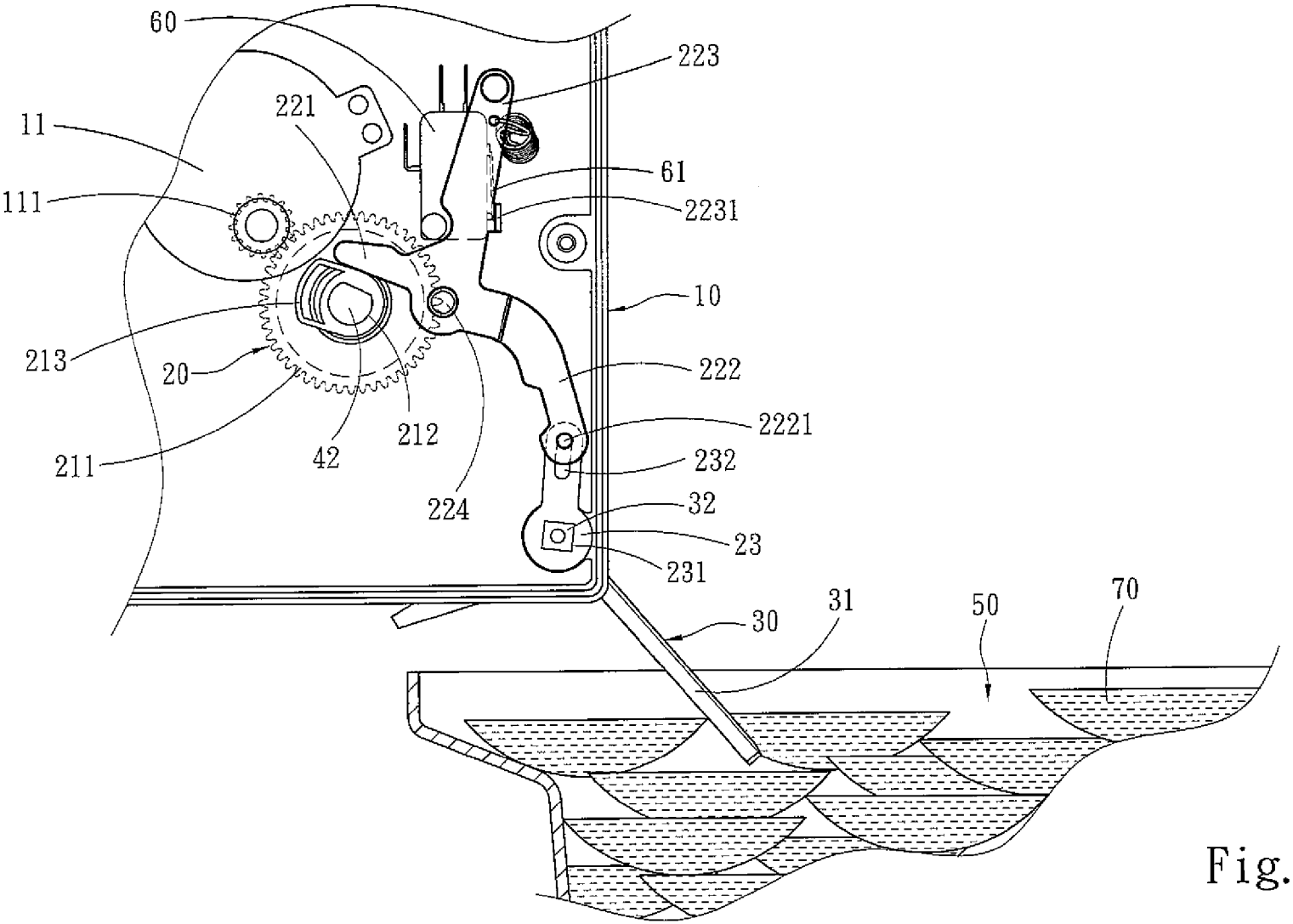
Figure 5B:
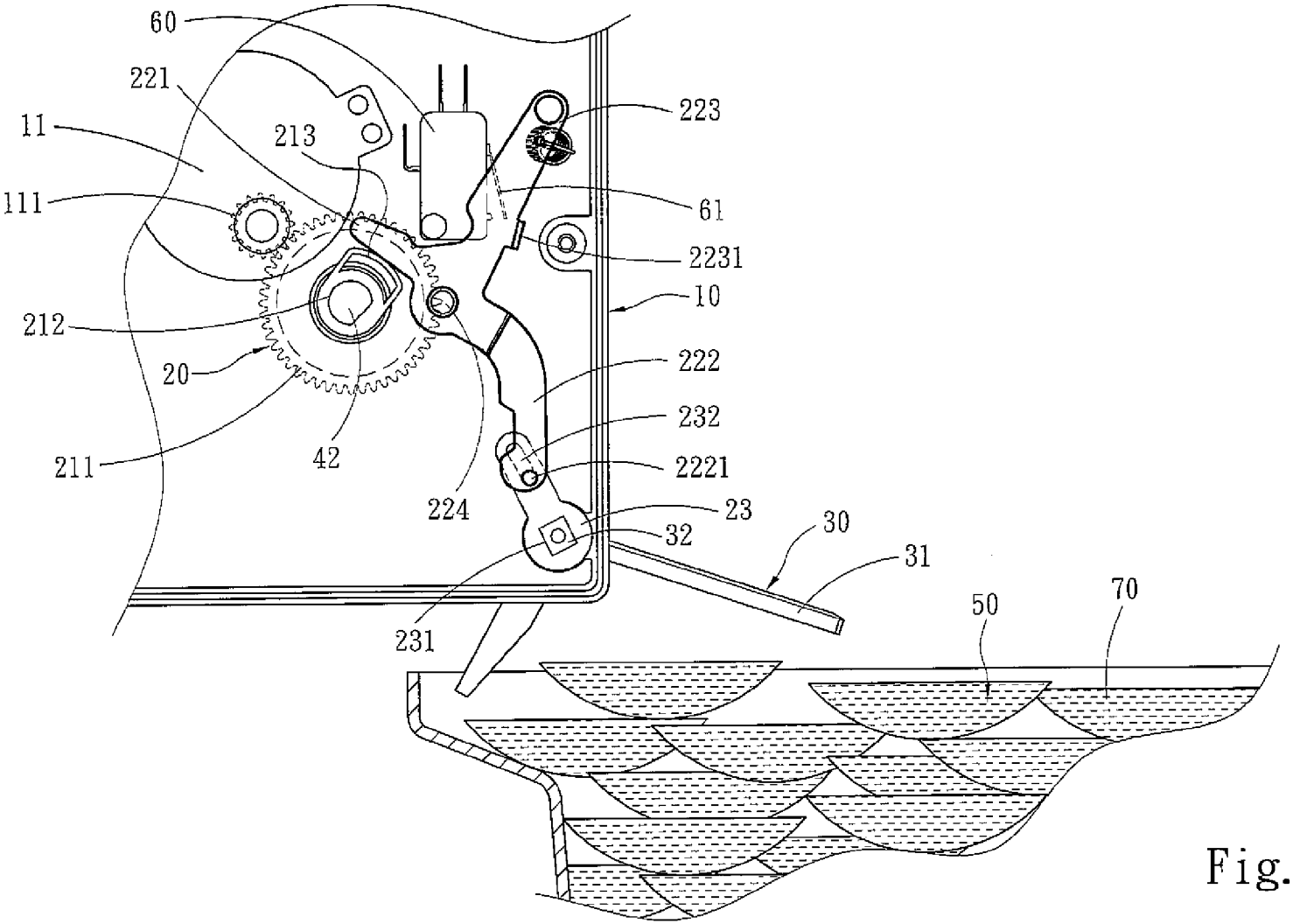
Figure 5C:
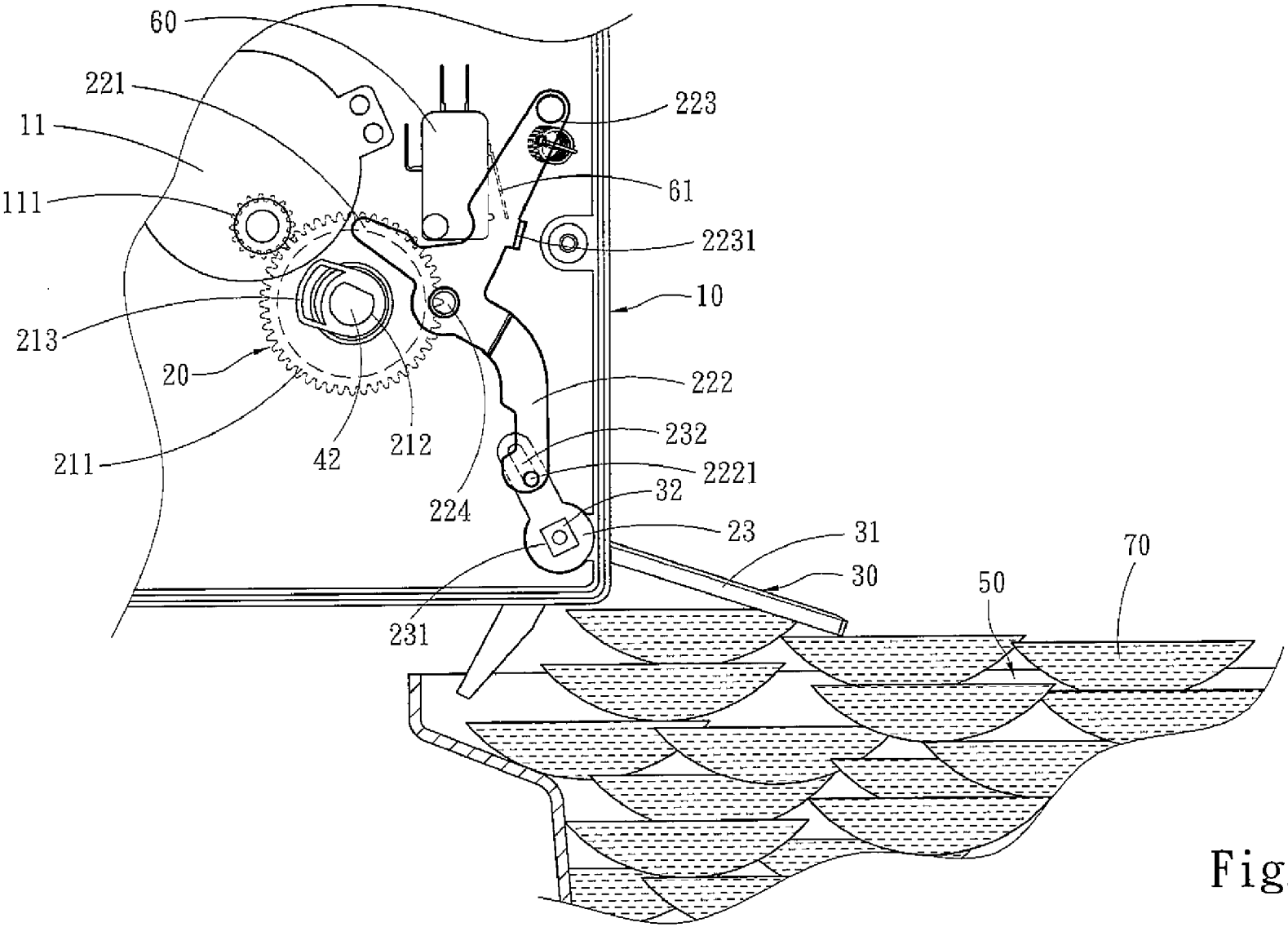

Please refer to FIGS. 2 and 3, the ice level detection structure for ice makers of the invention is located on an ice maker to detect the ice level of ice cubes 70 actually stored in an ice trough 50. The ice maker has an ice making tray 40 to freeze water to become the ice cubes 70 and an ice sweeping blade 41 above the ice making tray 40 to move the ice cubes 70 out of the ice making tray. There is a control box 10 at one side of the ice making tray 40 to control transmission of the elements of the ice maker. The ice trough 50 is located below the ice making tray 40 to store the ice cubes 70. The detection structure of the invention includes:

a detection rack 30 located above the ice trough 50 that has a transmission shaft 32 and a detection portion 31 connecting to the transmission shaft 32; and a motor 11 located in the control box 10 and a transmission means 20 located between the motor 11 and the transmission shaft 32. According to an embodiment of the invention the transmission means 20 includes a transmission member 21 driven by the motor 11, a crank element 22 driven by the transmission member 21 and a driven member 23 bridging the crank element 22 and the transmission shaft 32. The crank element 22 has an axis portion 224, a first lever 221 coupling with the transmission member 21 and a second lever 222 coupling with the driven member 23. The first lever 221 is driven by the transmission member 21 to turn about the axis portion 224 so that the second lever 222 is moved along an eccentric displacement to drive the driven member 23. The motor 11 has a first gear 111 to output driving power. The transmission member 21 has a second gear 211 to engage with the first gear 111 and an eccentric boss 213 to drive the first lever 221 while the second gear 211 is turning. The second gear 211 has a hub 212 to couple with an axle 42. The axle 42 is extended to the ice making tray 40 and fastened to the ice moving blade 41. The second gear 211 drives the ice moving blade 41 to generate an ice sweeping displacement. The driven member 23 has an axis 231 coupled with the transmission shaft 32. The driven member 23 and the second lever 222 have respectively a moving slot 232 and a stub 2221 corresponding to each other.

Referring to FIGS. 4A through 5C, when in use and the ice cubes 70 have been produced in the ice making tray 40 by the ice maker, the motor 11 outputs driving power to the transmission member 21 according to the gear ratio of the first gear 111 and second gear 211; the hub 212 drives the axle 42 so that the ice sweeping blade 41 fastened thereon also rotates to proceed the ice sweeping displacement; the eccentric boss 213 also synchronously pushes the first lever 221 so that the second lever 222 is moved about the axis portion 224 of the crank element 22 to form the eccentric displacement to drive the driven member 23. The stub 2221 of the second lever 222 is moved in the moving slot 232 to turn the transmission shaft 32 about the axis 231 so that the detection portion 31 is turned up and down to generate a detection displacement that includes a return position and a detection position. The crank element 22 also has a third lever 223 turning about the axis portion 224 to generate a second eccentric displacement while the first lever 221 is moving. Within the second eccentric displacement of the third lever 223 there is an ON/OFF switch 60. The third lever 223 further has a pressing portion 2231 and an elastic ON/OFF reed 61 corresponding to the ON/OFF switch 60 at a proximate location thereof. Referring to FIGS. 4B and 5B, during the ice making process and the ice sweeping blade 41 is moving the ice cubes, the detection portion 31 is moved upwards to the detection position, while the third lever 223 moves away from the ON/OFF switch 60 to stop the ice maker from making ice. When the ice sweeping blade 41 has swept the ice cubes 70 from the ice making tray 40 to drop into the ice trough 50, the detection portion 31 is moved downwards to the return position. If the ice cubes 70 in the ice trough 50 accumulate to a preset elevation and push the detection portion 31 such that the detection portion 31 cannot return to the return position and remains at the detection position, the ON/OFF switch 60 maintains the separated condition with the third lever 223. Hence the ice maker stops making ice. If the ice cubes 70 are not accumulated to the preset elevation, the detection portion 31 is moved downwards to the return position. The axis portion 224 or any lever (the axis portion 224 is taken as an example in the embodiment) may also be coupled with a return element 2241 (such as a spring to store and release an elastic force) to force the crank element 22 to return to a regular position.

Figure 6:
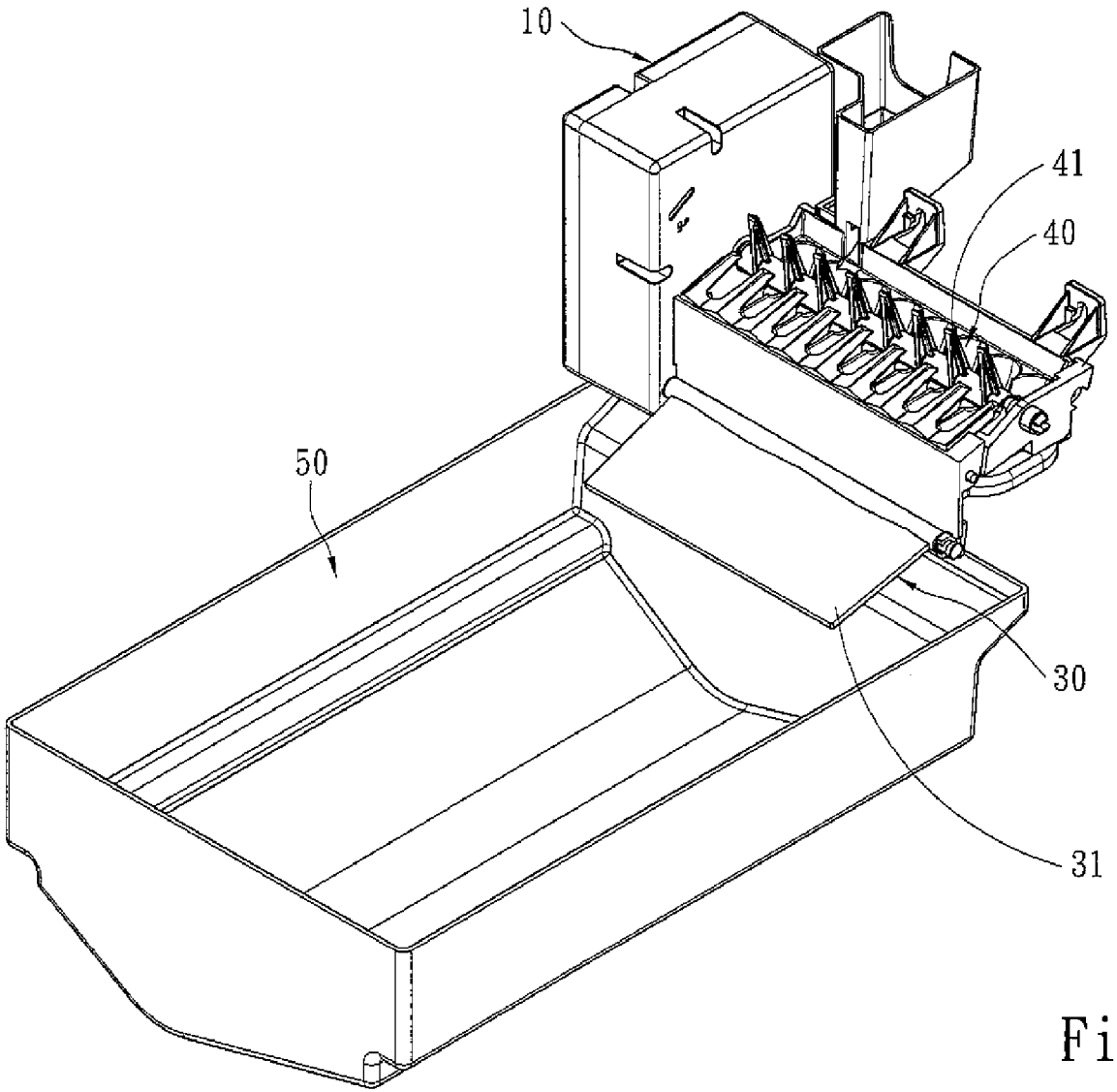
FIG. 6 is a schematic view of another embodiment of the invention.

By means of the invention, the transmission driving power increases The detection portion 31 may include one or more blades (as shown in FIG. 6). Hence the horizontal detection area also is bigger Therefore it does not fall into the cracks of the ice cubes 70 and becomes malfunctioned as the conventional ice maker does. Moreover, in the detection displacement of the invention detection process can be resumed again after the ice sweeping displacement is finished so that the ice level of the ice cubes 70 actually accumulated in the ice trough 50 can be judged more precisely. The detection portion 31 may also be made from plastics to save production cost. As previously discussed, the transmission means 20 of the invention transmits the driving power output from the motor 11 to the transmission shaft 32 to drive the detection portion 31, hence the detection portion 31 can judge more precisely the ice level of the ice cubes 70 actually stored in the ice trough 50 than the conventional detection structure.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An ice level detection structure for ice makers located on an ice maker to detect an ice level of ice cubes actually stored in an ice trough, comprising:

a detection rack which is located above the ice trough and has a transmission shaft and a detection portion connected to the transmission shaft; and a motor located in the ice maker and a transmission means interposed between the motor and the transmission shaft to transmit driving power output from the motor to drive the transmission shaft and the detection portion to generate a detection displacement in the ice trough that has a return position and a detection position to allow the detection portion to accurately judge the ice level of the ice cubes actually stored in the ice trough;

the transmission means including a transmission member driven by the motor, a crank element driven by the transmission member and a driven member bridging the crank element and the transmission shaft, the crank element having an axis portion, a first lever coupled with the transmission member and a second lever coupled with the driven member, the first lever being driven by the transmission member to turn about the axis portion so that the second lever generates an eccentric displacement to drive the driven member;

the crank element further having a third lever turnable about the axis portion to generate a second eccentric displacement while the first lever is turning, an ON/OFF switch being located within the second eccentric displacement of the third lever.

2. The ice level detection structure of claim 1, wherein the motor has a first gear to output the driving power, the transmission member having a second gear engaging with the first gear and an eccentric boss to drive the first lever while the second gear is turning.

3. The ice level detection structure of claim 2, wherein the second gear has a hub to couple with an axle which is extended in an ice making tray and coupled with an ice sweeping blade, the ice sweeping blade being driven by the second gear to generate an ice sweeping displacement.

4. The ice level detection structure of claim 1, wherein the driven member has an axis coupling with the transmission shaft, the driven member and the second lever having respectively a moving slot and a stub that are corresponding to each other.

5. The ice level detection structure of claim 1, wherein the third lever has a pressing portion and an elastic ON/OFF reed corresponding to the ON/OFF switch at a proximate location thereof.

6. The ice level detection structure of claim 1, wherein the axis portion is coupled with a return element to force the crank element to return to a regular position.

7. The ice level detection structure of claim 6, wherein the return element is a spring to store and release an elastic force.

8. The ice level detection structure of claim 1, wherein the detection portion includes one or a plurality of detection blades.

9. An ice level detection structure for ice makers located on an ice maker to detect an ice level of ice cubes actually stored in an ice trough, the ice maker having an ice making tray and an ice sweeping blade located above the ice making tray that is coupled with an axle extended to a control box which has a motor and a transmission means interposed between the motor and the axle to drive the ice moving blade to generate an ice sweeping displacement, the detection structure comprising:

a detection rack which is located above the ice trough and has a transmission shaft and a detection portion connected to the transmission shaft such that the transmission shaft generates a detection displacement in the ice trough through the driving power of the motor and the transmission means that has a return position and a detection position to allow the detection portion to accurately judge the ice level of the ice cubes actually stored in the ice trough;

the transmission means including a transmission member driven by the motor, a crank element driven by the transmission member and a driven member bridging the crank element and the transmission shaft, the crank element having an axis portion, a first lever coupled with the transmission member and a second lever coupled with the driven member, the first lever being driven by the transmission member to turn about the axis portion so that the second lever generates an eccentric displacement to drive the driven member;

the crank element further having a third lever turnable about the axis portion to generate a second eccentric displacement while the first lever is turning, an ON/OFF switch being located within the second eccentric displacement of the third lever.

10. The ice level detection structure of claim 9, wherein the motor has a first gear to output the driving power, the transmission member having a second gear engaging with the first gear and an eccentric boss to drive the first lever while the second gear is turning.

11. The ice level detection structure of claim 10, wherein the second gear has a hub to couple with an axle which is extended in an ice making tray and coupled with an ice sweeping blade, the ice sweeping blade being driven by the second gear to generate an ice sweeping displacement.

12. The ice level detection structure of claim 9, wherein the driven member has an axis coupling with the transmission shaft, the driven member and the second lever having respectively a moving slot and a stub that are corresponding to and engageable with each other.

13. The ice level detection structure of claim 9, wherein the third lever has a pressing portion and an elastic ON/OFF reed corresponding to the ON/OFF switch at a proximate location thereof.

14. The ice level detection structure of claim 9, wherein the axis portion is coupled with a return element to force the crank element to return to a regular position.

15. The ice level detection structure of claim 14, wherein the return element is a spring to store and release an elastic force.

16. The ice level detection structure of claim 9, wherein the detection portion includes one or a plurality of detection blades.

* * * * *